US005292281A

United States Patent [19]

Butler

[11] Patent Number: 5,292,281

[45] Date of Patent: Mar. 8, 1994

[54] VERTICAL SOFFIT VENT

[75] Inventor: Dennis Butler, McDonald, Pa.

[73] Assignee: Glenn Technologies, Inc., Cecil, Pa.

[21] Appl. No.: 821,920

[22] Filed: Jan. 16, 1992

[51] Int. Cl.[5] ..... F24F 7/02

[52] U.S. Cl. ..... 454/260; 52/95; 454/276

[58] Field of Search ..... 52/95; 454/260, 275, 454/276

[56] References Cited

U.S. PATENT DOCUMENTS

| | | | |
|---|---|---|---|
| 255,608 | 3/1882 | Eaton . | |
| 1,028,725 | 6/1912 | Hodgjun | 454/260 X |
| 2,032,967 | 3/1936 | Zorn | 52/95 |
| 2,968,128 | 1/1961 | Pelican | 454/260 X |
| 2,991,709 | 7/1961 | Haddix . | |
| 3,221,452 | 12/1965 | Gregoire | 52/95 |
| 3,373,676 | 3/1968 | Dunnington et al. | 454/260 |
| 3,426,488 | 2/1969 | Stanford | 52/95 X |
| 3,972,164 | 8/1976 | Grange | 52/95 |
| 4,200,034 | 4/1980 | Listle et al. . | |
| 4,222,315 | 9/1980 | Weirich . | |
| 4,315,455 | 2/1982 | Shaklee . | |
| 4,607,566 | 8/1986 | Bottomore et al. | 454/260 |
| 4,702,149 | 10/1987 | Speer . | |
| 4,807,409 | 2/1989 | Sells | 52/95 |
| 4,995,308 | 2/1991 | Waggoner | 454/260 |

*Primary Examiner*—Harold Joyce

*Attorney, Agent, or Firm*—Webb, Burden, Ziesenheim & Webb

[57] ABSTRACT

A vertical soffit vent in which a length of frieze board is affixed adjacent a length of soffit molding, with a unique arrangement of vents—volutes—in between. More particularly, a length of frieze board having particularly shaped and dimensioned volutes therein is attached or integrally molded to an adjacent length of molding by means of a solid spacer strip. (Alternatively, the spacer strip may be eliminated and replaced with protruding teeth on the frieze board.) The entire combination may be integrally molded. The volutes in the frieze board are contained in the upper half of the frieze board, in and around the solid spacer strip. The combined vertical soffit vent is intended for mounting under the eaves of roof constructions, and permits enhanced air flow into the attic area by means of the uniquely shaped volutes. The outlet ends of the volutes are covered with an insect screen.

12 Claims, 3 Drawing Sheets

VERTICAL SOFFIT VENT

FIELD OF THE INVENTION

The present invention relates to attic ventilation, and more particularly relates to a molding and vent system which is installed under an eave as a unit.

BACKGROUND OF THE INVENTION

Roof construction has a long and diverse architectural history. From the standpoint of construction alone, roofs for homes, buildings, stadiums or arenas or other constructs must not only provide a cover for the building but must be able to resist immense roof loads such as high winds and rain and, in many areas, snow and ice.

A typical roof type is that which is incorporated into a wood-framed dwelling. When the width of the roof area is less than about 30 feet, the roof surface—composition shingles or tile or slate placed on sheathing or plywood—may be supported on rafters or roof trusses which run from the peak of the roof to its eaves. When the width of the area to be covered exceeds about 30 feet, wooden roof trusses are usually used instead of rafters, and additional support may be furnished by the use of longitudinal members, known as purlins, that span the trusses. Industrial buildings often use essentially this same construction, except that the trusses, purlins and roofing are generally fabricated from steel or prestressed concrete or other high load-bearing materials.

No matter what type of roof construction is used, roof design must always accommodate the need for adequate attic ventilation. Satisfactory attic ventilation is necessary for many reasons. Attic ventilation not only removes heat and moisture from attic spaces in hot weather, but removes attic condensation in cold weather to prolong building structure and roof material life and to preserve the viability of the attic insulation.

Traditionally, in order to afford adequate ventilation, rafters or roof trusses were customarily extended well beyond the exterior wall of the dwelling or building, to form vented eaves. Ordinarily, the soffit, or horizontal underside of the eave, was fitted with vents of varying designs, which vents allowed air to pass into the attic from the outside. Hot, moist air inside the attic could then exit through roof vents, known in the art, positioned higher than the vents in the eave and thus able to create a chimney effect in the attic.

One typical vent for an eave of a roof is exemplified in U.S. Pat. No. 4,702,149 to Speer, in which tubes are provided to allow air to enter through the soffit. The tubes are constructed so that condensed moisture from inside the roof is collected and drained from a drain trap beneath the ventilating tubes. The general concept exemplified by Speer is the use of the soffit as an area of attic ventilation.

Simple vents in soffit are well known, and may comprise strip vents, spot vents or other ventilation apertures provided in the soffit. Usually the ventilation apertures are covered with either a louvre or screening material to discourage infestation of insects and other small life forms. U.S. Pat. No. 2,991,709 to Haddix represents a simple soffit vent of this type. U.S. Pat. No. 4,315,455 to Shaklee discloses a more elaborate variation on this theme, in which a central air flow space through the soffit is provided with a foraminous covering and an adjacent air scoop panel which may be positioned in either an open or in a closed position.

Other patents which allow attic ventilation from the area of the eave with ventilation channels of various types include U.S. Pat. No. 255,608 to Eaton, U.S. Pat. No. 3,972,164 to Grange, U.S. Pat. No. 4,200,034 to Listle et al., U.S. Pat. No. 4,222,315 to Weirich and U.S. Pat. No. 4,807,409 to Sells.

None of the prior art under-roof apertures for attic ventilation address the problem which the present invention solves, however. The traditional extension of roof rafters or roof trusses out over the exterior wall, to form eaves, was adopted in the first place to create what was believed to be soffit area necessary for attic ventilation. Requirements were developed over the years for amounts of ventilation which were required to be included in soffit structures, and a certain minimum soffit area itself became a typical minimum building standard, usually a 12–16 inch overhang. Creating large surface areas of soffit for the purpose of creating screened or louvred apertures in such a construct accounted for considerable construction cost. To make matters worse, not only did the existence of the eave create additional expense in the soffit design and construction, but increased roof area and need for roofing materials and labor commensurate with the roof area of the eave meant that the roofs themselves were bigger and more expensive than they would have needed to be merely to cover the building. A need remained in the roof construction industry, therefore, for a soffit vent in which eave construction could be simplified, roof area minimized and attic ventilation enhanced.

SUMMARY OF THE INVENTION

The present invention met this need with a vertical soffit vent in which a length of frieze board is positioned adjacent a length of soffit molding, with a unique arrangement of volutes (vents) and a spacer strip in between. More particularly, a length of frieze board having particularly shaped and dimensioned volutes therein is attached to an adjacent length of molding by means of a solid spacer strip. The volutes in the frieze board are contained in the upper half of the frieze board, in the area adjacent the solid spacer strip. Except for periodic "teeth" along the upper portion of the frieze board, which teeth abut and bond with the spacer strip, the upper surface of the frieze board is sculpted to create an overall concave louvre between the frieze board and the spacer strip. The concave louvre is covered—at the upper edge of the spacer strip and the upper surface of the frieze board—with a screen, mesh or other perforate material to prevent entry of insects or other small living things.

As an alternative embodiment, the solid spacer strip can be eliminated, with the spacing function provided instead by a protruding tooth.

The combined frieze board and soffit molding is best applied when eaves are almost entirely eliminated from the roof design, and measure as little as 3 inches or so in width. The usual spacing of the teeth on the frieze board is a 1¼ inch wide tooth every 13¼ inches, giving 12 lineal inches of ventilation for every 13¼ inches of length of the present molding/vertical soffit vent. With this degree of ventilation, eaves themselves are no longer necessary and the roof trusses may be shortened to extend only so far as is necessary to accommodate the present soffit vent (i.e., as little as 3 inches). With smaller eaves, roof area is reduced, and lower roofing costs add together with the simplicity of installation of the present vertical soffit vent to result in new and more cost effective roof designs, both for new construction and for retrofits and renovations. As compared with conventional eave ventilation, with the present invention air flow begins further down along the exterior wall to create a wall wind washing effect.

DETAILED DESCRIPTION OF THE INVENTION

The present invention is a vertical soffit vent in which a length of frieze board is affixed adjacent a length of soffit molding, with a unique arrangement of vents—volutes—in between. More particularly, a length of frieze board having particularly shaped and dimensioned volutes therein is attached to an adjacent length of molding by means of (in one embodiment of the invention) a solid spacer strip. The volutes in the frieze board are contained in the upper half of the frieze board, in the area adjacent the solid spacer strip. Except for periodic "teeth" along the upper portion of the frieze board, which teeth abut and bond with the spacer strip, the upper surface of the frieze board is sculpted to create a concave louvre between the frieze board and the spacer strip. The apertures thus provided between the frieze board and the soffit molding are covered—at the upper edge of the spacer strip and the upper surface of the frieze board—with a screen, mesh or other perforate material to prevent entry of insects into the attic or crawl space to be ventilated.

Figure 1:
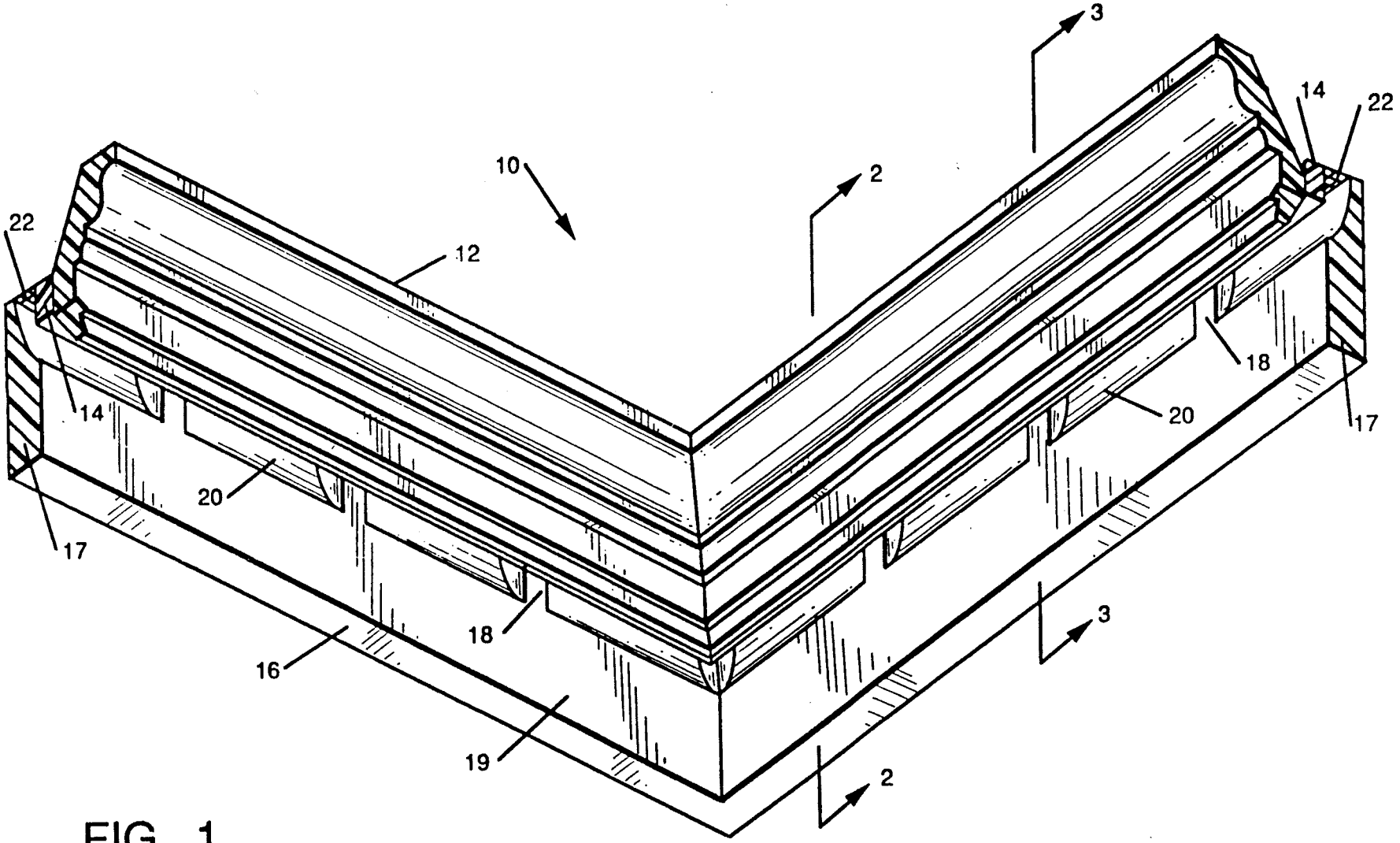
FIG. 1 is a perspective view of an inside premitered corner section of a vertical soffit vent according to the present invention.

Two of the four main components of the first embodiment of the present vertical soffit vent are of simple, straight-forward structural design. Referring now to FIG. 1, the vertical soffit vent 10 (an inside pre-mitered corner) includes the soffit molding 12, the spacer strip 14 and the frieze boards 16 having the teeth 18 and volutes 20 therein. The wood-like parts are molded of polymer, usually, and preferably are molded (most preferably as a single unit) of high density polyurethane. The soffit molding 12 is a molding known in the art, and the spacer strip 14 is merely a strip, as illustrated. The remaining structures are a little more complicated. The volutes 20 in the frieze boards 16 are periodic cutouts in the upper half of the face of the frieze board 16 opposite to the flat surface 17 of the frieze board 16, which flat surface 17 abuts the vertical exterior wall of the building. The insect screen 22 is affixed to the uppermost surfaces of the spacer strip 14 and the frieze board 16.

Figure 2:
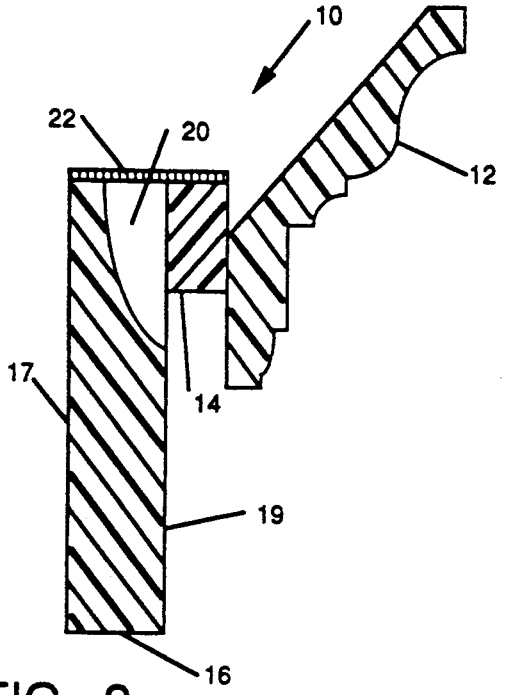
FIG. 2 is a sectional view along lines 2—2 of FIG. 1.
Figure 3:
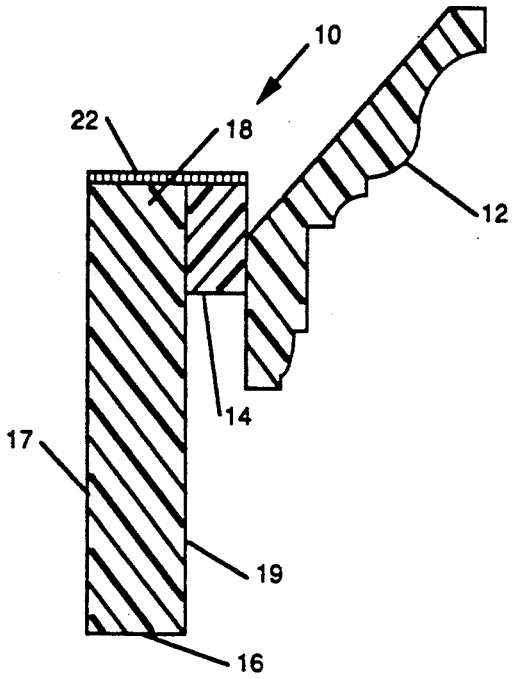
FIG. 3 is a sectional view along lines 3—3 of FIG. 1.

The abutment of the soffit molding 12, spacer strip 14, frieze board 16 and insect screen 22 is best seen in FIGS. 2 and 3. In FIG. 2, in which the frieze board 16 has a volute in the upper portion thereof, the frieze board does not abut the spacer strip 14 or the soffit molding 12 at all; only the soffit molding 12 and the spacer strip 14 are bonded (alternatively, unitarily molded) at their interface. As shown in FIG. 3, however, at the areas in the frieze board which contain a tooth 18, the frieze board 16, spacer strip 14 and soffit molding 12 all abut and are bonded (alternatively, unitarily molded) at their adjacent surfaces. The insect screen 22 extends atop the combined frieze board 16 and spacer strip 14 along the entirety of their lengths.

Referring once again to FIG. 1, the frieze board 16 has a flat surface 17 on the back side thereof and a volute 20 at periodic intervals along the upper portion of the front. More specifically, each volute 20 in the frieze board 16 is a concave cutout in the upper front surface, relieved at intervals by a non-cutout surface which forms a tooth. In fact, the use of the term "tooth" is particularly apt because the tooth 18 and the volute 20 are similar in shape (although not in periodicity) to the classic molding style known as "dentil" molding.

The non-corrosive insect screen 22 is preferably manufactured of a treated fiberglas or polymeric mesh material, but it may be constructed of painted metal or other inert, non-corrosive screens or perforate shields. The insect screen 22 is positioned atop the upper surfaces of the frieze board 16 and the spacer strip 14 both to keep the insect screen 22 away from the elements and to provide a better appearance than if the insect screen spanned the soffit molding 12 and the front surface 19 of the frieze board 16. Also, with the insect screen 22 in the position as shown, neither the insect screen nor the present vertical soffit vent can possibly be painted shut, no matter how many times the molding and/or frieze boards are painted.

Various molding profiles may be used for the soffit molding 12 other than the profile as shown. Crown molding, massive crown molding, crown dentil molding and other molding profiles may be used in place of the specific molding profiles shown as the soffit molding 12 in the Figures. Likewise, the lower portion of the frieze board 16 may have a different profile if desired; it is the combined volute 20 and tooth 18 which defines the functional portion of the frieze board 16. Ideally, the vertical width of the volute 20 at its inlet is 1 inch, with the spacer strip 14 as the upper boundary, so that each 12-inch section of ventilation represents 12 square inches of inlet air flow.

The geometry of the volute is concave and tapered. The inlet end of the volute (the end furthest from the insect screen 22) is preferably 1 inch in vertical width and 12 inches long, but the taper of the volute 20 ends in an outlet end of the volute 20 which is preferably $1\frac{3}{4}$ inches wide. This shape enhances air flow into the attic with an effect similar to if not identical to the venturi effect.

The vertical soffit vent according to the present invention may be prefabricated as an inside pre-mitered corner as shown in FIG. 1, but may be likewise fabricated as outside pre-mitered sections or straight sections. One reason why the volutes 20 are no more than about 12 inches in length is that a greater space would render the vertical soffit vent unwieldy for cutting and piecing into position. In other words, the present vertical soffit vent is frequently provided in lengths which may be cut to fit—and volutes having a length greater than 12 inches make the product too difficult to piece or to fit into place without unacceptable loss of the important structural teeth 18.

Variation in the dimensions of the volute 20 may include a width variation at the insect screen 22 of between 1 and 2 inches, and the horizontal length of the volute 20 may be anywhere up to but generally not exceeding about 12 inches. The vertical soffit vent itself may be made in any length but is typically prefabricated in 12-foot lengths. Joining end caps may be provided to abut and/or adjoin adjacent segments of vertical soffit vent.

The combined frieze board and soffit molding is best applied when eaves are eliminated entirely from the roof design. The usual spacing of the teeth on the frieze board is a 1¼ inch wide tooth every 13¼ inches, giving 12 lineal inches of ventilation for every 13¼ inches of the present molding/vertical soffit vent. Federal Housing Administration regulations require only about 9 square inches of ventilation per lineal foot of eave soffit.

With the high degree of ventilation of the present invention, eaves themselves are no longer necessary and the roof trusses may be shortened to extend only so far as is necessary to accommodate the present soffit vent. In fact, as described above only a 3 inch width of eave soffit is required, as compared with a typical prior art 12–16 inch wide eave. With smaller eaves, roof area is reduced, and lower roofing costs add together with the simplicity of installation of the present vertical soffit vent to result in new and more cost effective roof designs for new construction and for retrofits and renovations.

The vertical soffit vent according to the present invention offers a number advantages over previously known soffit ventilation systems. As described above, the present invention eliminates the need to extend the soffit overhang and in fact eliminates soffit material, accessories and labor. The present invention starts ventilation further down the structural wall, creating a wind wall washing effect. By downsizing truss tails, the present vertical soffit vent allows reduction in labor and materials expense for roofing itself, as discussed above. In fact, at this writing the use of the present vertical soffit vent over existing soffit ventilation systems typically results in a cost savings, on roofing alone, of over two thousand United States dollars.

Beyond the savings in soffit and roof material and roof area, the present invention also combines the functional utility of an attic ventilation system with the attractiveness of a molding profile such as is shown in particular in FIG. 1. Moreover, the prefabrication of the vertical soffit vent means that it is quickly installed with minimal labor cost. The enhanced attic ventilation afforded by the present invention is particularly beneficial in view of the fact that the custom of increasing attic insulation has itself exacerbated the trapping of moisture laden hot air, in attic spaces. Were hot, moist air allowed to remain in an attic, the roof, rafters or roof trusses, insulation and indeed the entire upper structure of the building would deteriorate at an unacceptably accelerated rate.

The various components of the present vertical soffit vent, with the exception of the insect screen, are formed of injection-molded high density plastic, preferably polyurethane, or closed cell high density polyurethane foam. Polyurethane or polymeric molding of this type is known in the art. The molding/spacer strip/frieze board combination is most preferably molded as a unit, although the individual elements may be separately fabricated and bonded, as shown in the Figures. Molding of the complete unit in a single piece is both cost effective and further discourages infestation.

Figure 4:
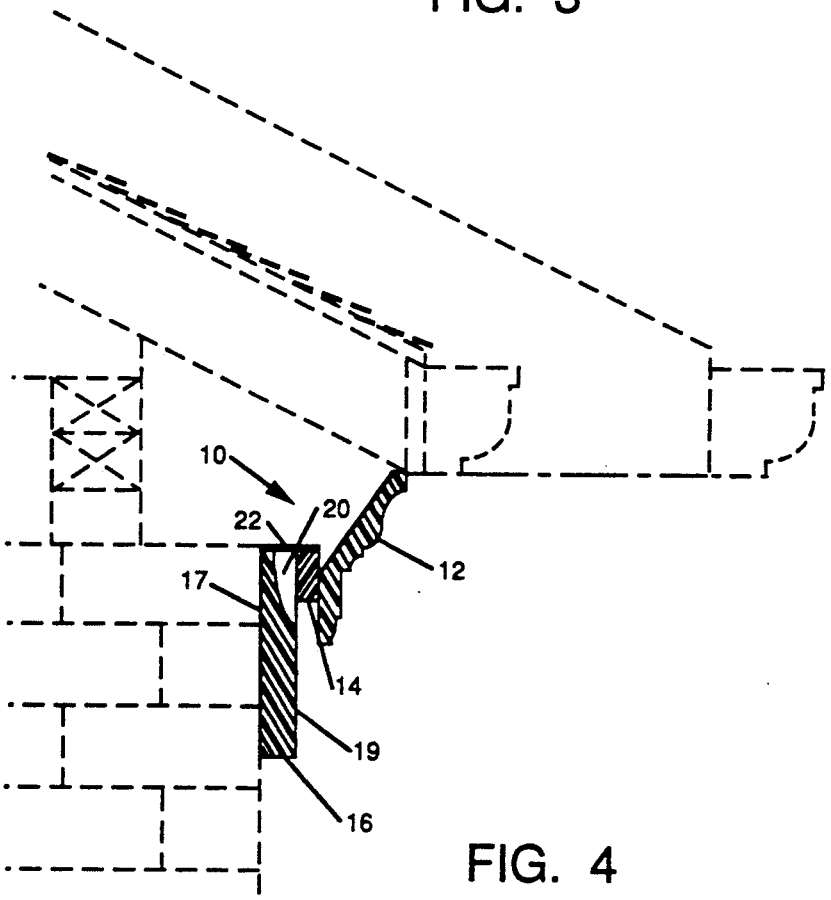
FIG. 4 is a sectional view showing the present soffit vent in position under the edge of a roof of a building.

FIG. 4 illustrates the savings in roof area and soffit area by designing the roof to accommodate the present vertical soffit vent 10. In most cases on upscale designs, eave decorations are used in the form of cove and frieze dentil, crown frieze and other popular molding profiles. The angled profile of the vertical soffit vent serves as a drip edge when the soffit is subjected to wind driven rain.

Figure 5:
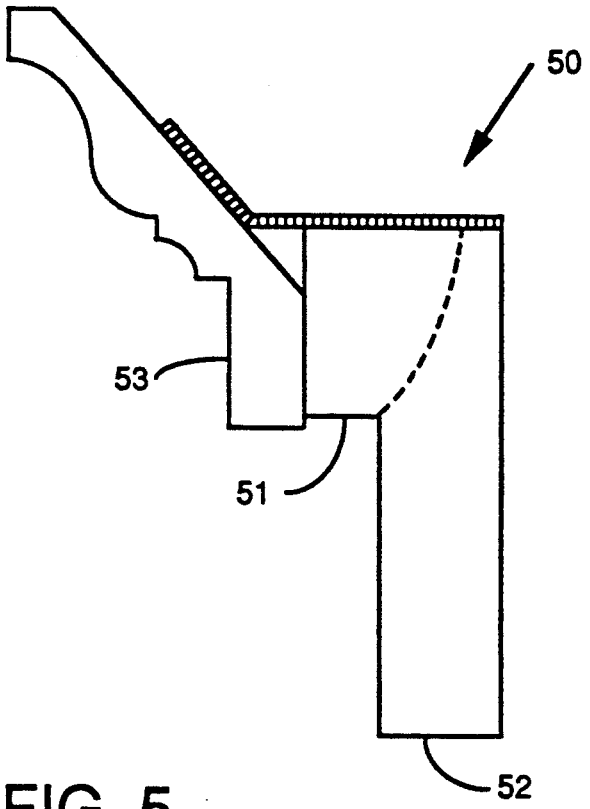
FIG. 5 is an end elevational view of an alternate embodiment of the present invention.

An alternate embodiment of the invention is shown in end elevational view in FIG. 5. Instead of the spacer strip of the first embodiment, a protruding tooth 51 of the frieze board 52 preserves the space between the frieze board 52 and the soffit molding 53 of the unitary molded vent 50. The outline of the volute (not visible in this end view but otherwise structurally the same as in FIGS. 1–4, but for the removal of the spacer strip and the substitution of the protruding tooth) is shown by a dotted line. As in the first described embodiment of the invention, the horizontal length of the volute may be anywhere up to but generally not exceeding about 12 inches.

Although the invention has been described with particularity above, it is to be considered as limited only insofar as is set forth in the accompanying claims.

I claim:

1. A vertical soffit vent, comprising:

a length of soffit molding, and a frieze board affixed adjacent said soffit molding, said frieze board further having a plurality of volutes extending along a portion of the frieze board therein between the front face of said frieze board and the uppermost horizontal surface of said frieze board, said volute being a concave cutout in said frieze board and said volute further having an inlet end and an outlet end, wherein said outlet end of said volute is covered by an insect screen.

2. The vertical soffit vent as set forth in claim 1 wherein said soffit molding is crown molding.

3. The vertical soffit vent as set forth in claim 2 wherein said soffit molding is massive crown molding.

4. The vertical soffit vent as set forth in claim 2 wherein said soffit molding is crown dentil molding.

5. The vertical soffit vent as set forth in claim 1 wherein said insect screen is fabricated of treated fiberglas.

6. The vertical soffit vent as set forth in claim 1 wherein said frieze board and said soffit molding are positioned adjacent each other by means of a spacer strip.

7. The vertical soffit vent according to claim 6 wherein said spacer strip, said soffit molding and said freeze board are integrally molded of high-density polyurethane.

8. The vertical soffit vent as set forth in claim 1 wherein said volute is concave, has a length of about 12 inches, a vertical width at its inlet end of about 1 inch and a width at its outlet end of about 1¾ inch.

9. The vertical soffit vent according to claim 8 wherein the soffit vent is accommodated within about a 3 inch wide eave.

10. The vertical soffit vent according to claim 1 wherein said frieze board and said soffit molding are fixedly spaced apart from each other by means of a plurality of protruding teeth on said frieze board.

11. The vertical soffit vent according to claim 1 wherein said frieze board having a plurality of protruding teeth thereon and said soffit molding are integrally molded of high-density polyurethane.

12. A vertical soffit vent, comprising:

a length of soffit molding, and a frieze board affixed adjacent said soffit molding, said frieze board further having a plurality of volutes extending along a portion of the frieze board therein between the front face of said frieze board and the upper most horizontal surface of said frieze board, said volute being a periodic cutout in said frieze board and said volute further having an inlet and an outlet end, wherein said outlet end of said volute is covered by an insect screen.

* * * * *

UNITED STATES PATENT AND TRADEMARK OFFICE

CERTIFICATE OF CORRECTION

PATENT NO. : 5,292,281

DATED : March 8, 1994

INVENTOR(S) : Dennis Butler

It is certified that error appears in the above-indentified patent and that said Letters Patent is hereby corrected as shown below:

Column 4 Line 18 "fiberglas" should read —fiberglass—.

Column 5 Line 27 after "number" insert —of—.

Claim 5 Lines 42-43 Column 6 "fiberglas." should read —fiberglass.—.

Claim 7 Line 50 Column 6 "freeze" should read —frieze—.

Signed and Sealed this

Ninth Day of August, 1994

Bruce Lehman

*Attest:*

BRUCE LEHMAN

*Attesting Officer*

*Commissioner of Patents and Trademarks*